US010421648B2

(12) United States Patent
Hess et al.

(10) Patent No.: US 10,421,648 B2
(45) Date of Patent: Sep. 24, 2019

(54) CRANE

(71) Applicant: Liebherr-Werk Biberach GmbH, Biberach an der Riss (DE)

(72) Inventors: Alfred Hess, Gutenzell/Huerbel (DE); Robert Bramberger, Mittelstetten/Vogach (DE)

(73) Assignee: Liebherr-Werk Biberach GmbH, Biberach an der Riss (DE)

( * ) Notice: Subject to any disclaimer, the term of this patent is extended or adjusted under 35 U.S.C. 154(b) by 287 days.

(21) Appl. No.: 14/907,462

(22) PCT Filed: Jul. 11, 2014

(86) PCT No.: PCT/EP2014/001920
§ 371 (c)(1),
(2) Date: Jan. 25, 2016

(87) PCT Pub. No.: WO2015/010774
PCT Pub. Date: Jan. 29, 2015

(65) Prior Publication Data

US 2016/0185575 A1 Jun. 30, 2016

(30) Foreign Application Priority Data

Jul. 26, 2013 (DE) ..... 10 2013 012 468

(51) Int. Cl.
*B66C 23/28* (2006.01)
*B66C 23/70* (2006.01)

(52) U.S. Cl.
CPC ..... *B66C 23/286* (2013.01); *B66C 23/70* (2013.01)

(58) Field of Classification Search
CPC ..... B66C 23/286; B66C 23/70; B66C 23/64; B66C 23/62
See application file for complete search history.

(56) References Cited

U.S. PATENT DOCUMENTS 6,499,612 B1 * 12/2002 Harrgington ..... B66C 23/701 212/270

FOREIGN PATENT DOCUMENTS

CN 101691191 A 4/2010
CN 102815629 A 12/2012
(Continued)

OTHER PUBLICATIONS

DE 2351177 Machine Translation—Reich (Apr. 1975) (Year: 1975).*
(Continued)

*Primary Examiner* — Michael R Mansen
*Assistant Examiner* — Juan J Campos, Jr.
(74) *Attorney, Agent, or Firm* — McCoy Russell LLP

(57) ABSTRACT

The present invention relates to a crane having a multiple-piece longitudinal structural part, in particular a tower or boom, whose pieces comprise corner arms or horizontal beams which can be placed next to one another and which can be releasably connected to one another by a mortise and tenon joint, wherein the mortise and tenon joint comprises a tongue which can be plugged into a tongue receiver and which can be fixed by means of at least one crossbar which can be inserted transversely to the plug-in direction of the tongue. In accordance with the invention, the crossbar of the mortise and tenon joint can be spread apart by a spreading device such that the pieces of the longitudinal structural part to be connected can be clamped to one another by spreading apart the crossbar.

19 Claims, 12 Drawing Sheets

(56) References Cited

FOREIGN PATENT DOCUMENTS

| | | | |
|---|---|---|---|
| DE | 1111461 | B | 7/1961 |
| DE | 2337769 | A1 | 2/1975 |
| DE | 2351177 | A1 | 4/1975 |
| DE | 2918485 | C2 | 8/1990 |
| EP | 0530114 | A1 | 3/1993 |
| FR | 2177408 | A5 | 11/1973 |
| FR | 2247417 | A1 | 5/1975 |
| FR | 2426176 | A1 | 12/1979 |

OTHER PUBLICATIONS

Machine Translation of DE 2,918,485 (Year: 1990).*
State Intellectual Property Office of the People's Republic of China, Office Action and Search Report Issued in Application No. 201480046052.0, dated Feb. 4, 2017, 25 pages. (Submitted with Partial Translation).
ISA European Patent Office, International Search Report Issued in Application No. PCT/EP2014/001920, dated Oct. 2, 2014, WIPO, 2 pages.

* cited by examiner

CRANE

CROSS REFERENCE TO RELATED APPLICATIONS

The present application is a U.S. National Phase of International Patent Application Serial No. PCT/EP2014/001920, entitled "Crane," filed on Jul. 11, 2014, which claims priority to German Patent Application No. 10 2013 012 468.9, filed on Jul. 26, 2013, the entire contents of each of which are hereby incorporated by reference in their entirety for all purposes.

TECHNICAL FIELD

The present invention relates to a crane having a multiple-piece longitudinal structural part, in particular a tower or boom, whose pieces comprise corner arms or horizontal beams which can be releasably connected to one another by a mortise and tenon joint, wherein the mortise and tenon joint comprises a tongue which can be plugged into a tongue receiver and which can be fixed by means of at least one crossbar which can be inserted transversely to the plug-in direction of the tongue.

BACKGROUND AND SUMMARY

With cranes, their longitudinal structural parts such as the tower or the boom are as a rule composed of a multiple of pieces to achieve a better transportation capability. The longitudinal structural pieces, which can in particular be configured as latticework carriers or frame carriers, in this respect often comprise horizontal beams or corner arms which are placed next to one another at the front face or end face on assembly and which are connected to one another by a mortise and tenon joint. In this respect, a projecting tongue is provided at the horizontal beam or corner arm of the one piece and moves into a tongue receiver which is provided at the other horizontal beam or corner arm to be connected thereto and which can, for example, be formed by the inner space of the horizontal beam or corner arm frequently formed as a hollow section or by a connection piece involved therein. In this respect, tower parts or boom parts of a crane frequently each have a plurality of such horizontal beams or corner arms which may extend in parallel with one another and which are connected to one another by transverse connectors, for example in the form of bars. Tower parts of tower slewing cranes, for example, frequently have a rectangular cross-section which is defined by four corner arms which are connected to one another by transverse and diagonal bars. The four corner arms of such a tower piece are connected in the named manner to the four corner arms of a next tower piece by four mortise and tenon joints.

It is understood that the named mortise and tenon joints should be configured as precisely and as free of tolerances as possible in order not to impair the stability of the longitudinal structural part and thus the support capability of the crane however, limits often being set by production tolerances since excessive press fits are not acceptable and would impair the assembly or dismantling.

It is therefore the underlying object of the present invention to provide an improved crane of the said kind which avoids disadvantages of the prior art and further develops the latter in an advantageous manner. The mortise and tenon joint for connecting the tower pieces or boom pieces should in particular be improved such that a higher support capability is achieved without sacrificing the assembly-friendliness.

This object is achieved in accordance with the invention by a crane in accordance with claim 1. Preferred embodiments of the invention are the subject of the dependent claims.

It is therefore proposed to configure the crossbar securing the mortise and tenon joint as spreadable to be able to clamp or tension to one another the mortise and tenon joints and then the pieces of the longitudinal structural part to be connected. While a preloaded connection of the structural part pieces can be achieved by spreading apart the cross bolt or crossbar, the non-spread apart state of the crossbar allows a simple assembly and dismantling, including joining and releasing the mortise and tenon joints. In accordance with the invention, the crossbar of the mortise and tenon joint can be spread apart by a spreading device such that the pieces of the longitudinal structural part to be connected can be clamped to one another by spreading apart the crossbar. The spreading apart of the crossbar is accompanied by a widening or an increase in the cross-section of the crossbar which, on the one hand, secures the crossbar itself to the tongue or to the tongue receiver and, on the other hand, clamps the tongue and the tongue receiver to one another and thus the structural part pieces to one another. The structural part pieces can be held by a compressive force on one another. The support capability of the crane can be considerably improved by such a clamping of the structural part pieces to be connected.

The crossbar can in particular—when viewed in the inserted state—be able to be spread apart in the longitudinal direction of the tongue and/or in the longitudinal direction of the longitudinal structural part such that the tongue can be drawn or pressed into the tongue receiver and the pieces of the longitudinal structural part to be connected to one another can be clamped to one another in its longitudinal direction. The spreading of the crossbar transversely to its longitudinal direction is therefore oriented such that the corner arms or horizontal beams to be connected are clamped end face to end face or the longitudinal structural parts to be connected are clamped with respect to one another at the end faces. The longitudinal structural part pieces are held on one another by a compressive force due to the tensioning, with said compressive force considerably increasing the support capability of the longitudinal structural part and thus of the crane.

The spreading device or the crossbar which can be spread apart can generally be configured differently to achieve the desired spreading apart capability. In accordance with an advantageous further development of the invention, the crossbar can comprise at least two spreading parts which are displaceable relative to one another in the longitudinal direction of the crossbar and which comprise at least one oblique surface which converts a relative movement of the spreading parts with respect to one another in the named longitudinal direction of the crossbar into a spreading movement transverse to the named longitudinal direction of the bar. The named oblique surface can in this respect in particular be inclined at an acute angle with respect to the longitudinal axis of the crossbar to be able to spread apart the outer contour of the crossbar in accordance with the wedge principle.

The named oblique surface can in this respect have different contours, for example in the form of a conical oblique surface in the manner of a drill chuck or, for example, such that a spreading cone can be inserted into an inner recess of a crossbar sleeve which can, for example, be longitudinally slit and which can be spread apart by inserting the spreading cone.

In an advantageous further development of the invention, the oblique surface can, however, also form a slanted longitudinal sectional plane through the crossbar and/or can be formed such that the spreading apart of the crossbar substantially takes place one-dimensionally, i.e. the cross-sectional dimension of the crossbar increases in a plane on a spreading part of the crossbar and remains substantially the same in a plane perpendicular thereto. By spreading apart the crossbar, its extent in the longitudinal direction of the tongue and/or in the longitudinal direction of the longitudinal structural part can in particular be increased while the crossbar dimension in the direction transverse to the named longitudinal axis remains substantially the same. The oblique surface or wedge surface can in particular be approximately planar.

In an advantageous further development of the invention, the two named spreading parts of the crossbar can form spreading wedges which can be displaced with respect to one another in the longitudinal direction of the crossbar and which can slide off one another, optionally with the interposition of an intermediate piece. The two spreading wedges can in particular form crossbar half-shells seated on one another which are arranged in opposite directions to one another or which are seated on one another in opposite directions, i.e. whose thinner ends face the oppositely disposed sides of the crossbar. The two crossbar half-shells can together form an approximately pin-like crossbar which is divided into the two named half-shells by a longitudinal sectional plane or oblique surface which is slanted or which extends at an acute angle with respect to the longitudinal pin direction.

The crossbar can, however, also comprise more than two such spreading parts in a further development of the invention, in particular three, but optionally also more than three, spreading parts which are displaceable relative to one another in the longitudinal direction of the crossbar and which advantageously each comprise oblique surfaces which are each aligned transversely with respect to a common spreading plane so that the spreading effect of the plurality of oblique surfaces moves in the same direction or acts in a common spreading plane so that the widening of the crossbar is in turn substantially one-dimensional in the aforesaid manner.

On a configuration of the crossbar with three or more spreading parts, in particular a middle wedge having two oppositely disposed wedge surfaces or oblique surfaces can be arranged between two outer wedges which can both be oriented in opposite directions with respect to the named middle wedge, i.e. whose thinner ends face to one side while the thin end of the middle wedge faces the oppositely disposed side. The two outer wedges can in particular bound a V-shaped intermediate space between them in which the named middle wedge is seated.

The spreading parts of the crossbar can generally have different cross-sections, for example an angled, in particular a rectangular, cross-section. To achieve a better distribution of the surface pressures occurring due to the spreading effect, the spreading parts of the crossbar can, however, also have an approximately crescent-shaped cross-section or a semi-oval cross-section or can at least have a rounded side surface or wall side or shell side, in particular having an approximately semicircular contour, at least about the spreading-apart axis in an advantageous further development of the invention.

The named spreading parts can in particular be planar on the rounded sides and oppositely disposed sides or can have oblique surfaces which are of an approximately planar design.

The named preferably crescent-shaped contouring can be provided for both spreading parts with a two-part configuration of the crossbar. If the crossbar is composed of three or more spreading parts, in particular the two outermost spreading parts can have the named approximately crescent-shaped cross-sectional contouring.

Viewed overall, the crossbar can have a cross-sectional contouring differing from the circular shape. However, on the one hand, an incorrect insertion of the crossbar into the reception provided therefore in the tongue or the tongue reception of the mortise and tenon joint can be avoided. On the other hand, it can be ensured on the spreading apart of the crossbar in one direction that the crossbar is still seated with an exact fit in the tongue or in the tongue receiver or in the crossbar receiver provided therein in a direction perpendicular thereto.

The crossbar can in particular have an approximately oval cross-section viewed overall which results from the sum of the cross-sections of the spreading parts seated on one another, in particular the two approximately crescent-shaped spreading wedges and the middle wedge optionally provided therebetween.

The orientation of the cross-section of the crossbar differing from the circular shape is advantageously selected in this respect such that the crossbar has a main cross-sectional axis which extends approximately in parallel with the longitudinal direction of the tongue and/or with the longitudinal direction of the structural part. If the crossbar is provided with an approximately oval cross-section in the named manner, the long main axis of the oval can extend in parallel with the longitudinal axis of the tongue or of the structural part.

In this respect, reception cut-outs for the named at least one crossbar can be provided in the tongue and/or in the tongue receiver or in the wall surrounding the tongue receiver so that the crossbar can be plugged into the crossbar through the tongue receiver, preferably completely through the tongue and through the walls of the tongue receiver surrounding at oppositely disposed sides.

The named plug-in or plug-through cut-out for the crossbar is in this respect advantageously matched in shape to the cross-section or to the cross-section contour of the crossbar. The named plug-through cut-out in the tongue and/or in the tongue receiver can in particular be formed in elongate hole shape in cross-section, with the longer main axis of this plug-through cut-out having a contour in the manner of an elongate hole advantageously being able to extend approximately in parallel with the longitudinal axis of the tongue or of the longitudinal axis of the longitudinal structural part.

To achieve the previously explained longitudinal tensioning of the longitudinal structural part pieces to be connected to one another, a slightly offset arrangement of the plug-through cut-outs in the tongue and in the tongue receiver of the mortise and tenon joint can be provided in an advantageous further development of the invention, in particular such that the plug-through cut-outs in the tongue and in the tongue cut-out are spaced apart by different distances from the end surfaces with which the pieces of the longitudinal structural part are to be spanned on one another so that a flush overlap can only be achieved under a preload by spreading apart the crossbar. The plug-in cut-out for the crossbar in the tongue or its marginal contour provided toward the tongue base can in particular be arranged closer to the end face of the horizontal beam or corner arm having the tongue than the plug-in opening for the crossbar in the tongue receiver of the other corner arm or horizontal beam cooperating therewith is spaced apart from the end-face connection contour provided there. If the two tower pieces or boom pieces are placed loosely at one another and are inserted with the tongues at the corner arms or horizontal beams into the corresponding tongue cut-outs, the margins of the plug-in cut-out are still not exactly flush. This flush alignment or flush placing over one another is only approximately achieved by spreading apart the inserted crossbar or the offset is reduced a little when the crossbar is spread apart, which is accompanied by the desired pre-load of the structural part pieces to be connected.

The adjustment movement for spreading apart the crossbar can generally be generated in different manners. For this purpose, the spreading device can comprise adjustment means for delivering at least a part of the crossbar in the longitudinal direction of the crossbar, with the named adjustment means advantageously being able to comprise an adjustable tie rod, preferably in the form of a screw, with which one of the spreading parts of the crossbar can be displaced relative to another spreading part. For this purpose, an abutment part can in particular be provided which abuts one of the spreading parts at the end face, on the one hand, and which supports the named tie rod or the named screw, on the other hand, so that the other spreading part can be moved toward the abutment by delivering the tie rod or the screw. Only the spreading parts of the crossbar are hereby advantageously acted on relative to one another by the adjustment or drive forces, whereas a corresponding introduction of the forces into the structural parts is not necessary. The abutment intercepts the adjustment force and its reaction force.

The named abutment can be formed, for example, in the form of a hoop part which can surround the corner arm or the horizontal beam of the longitudinal structural part in the region of the connection point. The named abutment can be secured at at least one of the longitudinal structural part pieces, for example by a screw connection, to avoid an unintentional slipping out of the crossbar.

The invention will be explained in more detail in the following with respect to preferred embodiments and to associated drawings.

DETAILED DESCRIPTION

Figure 1:
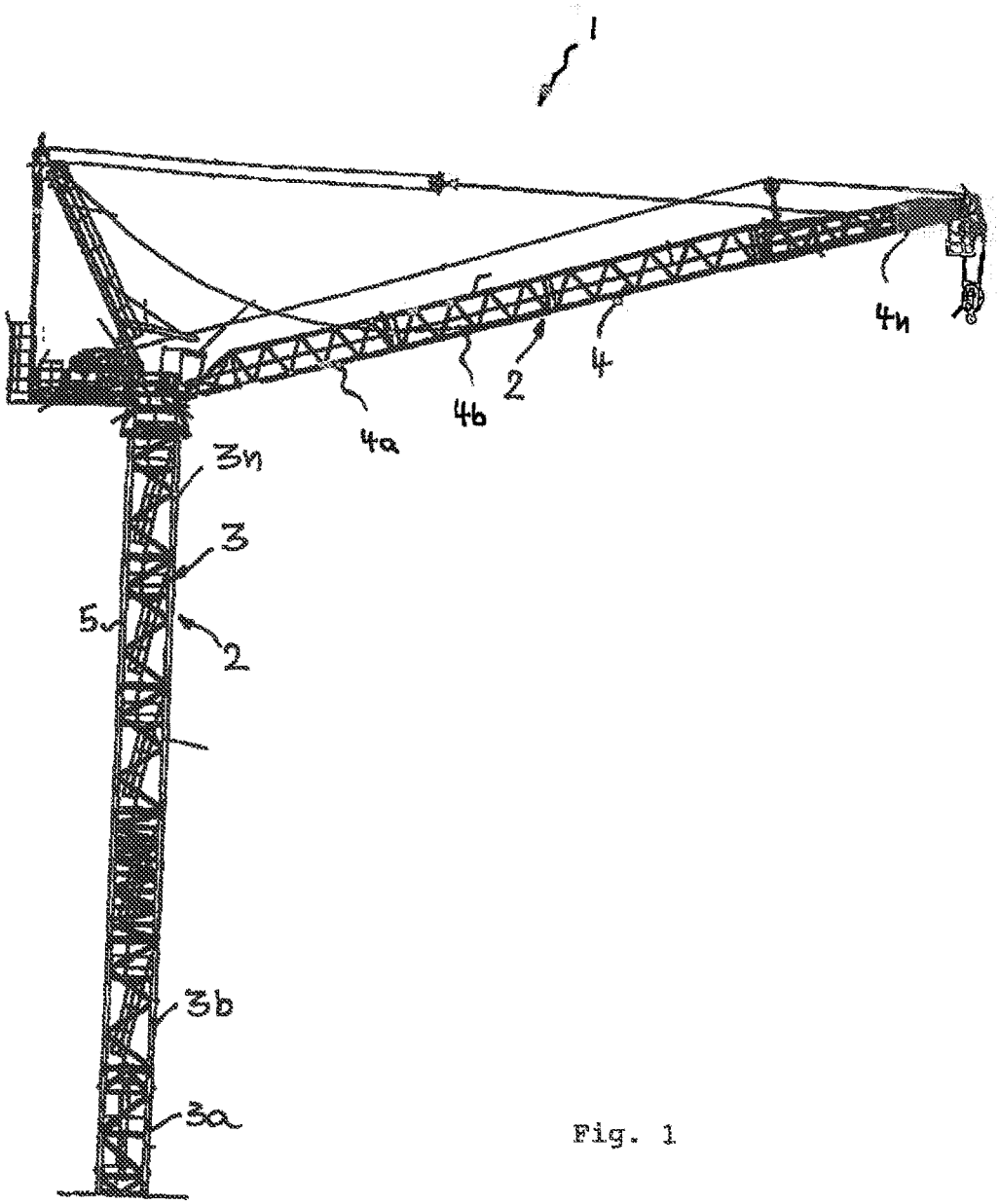
FIG. 1 shows a schematic side view of a tower slewing crane in accordance with an advantageous embodiment of the invention whose tower is composed of a plurality of tower pieces which can be tensioned with one another by means of a mortise and tenon joint with a spreadable crossbar.

As FIG. 1 shows, the crane 1 can comprise as longitudinal structural parts 2 a tower 3, on the one hand, and a boom 4 connected in an articulated manner thereto and projecting therefrom, on the other hand, wherein the tower 3 and the boom 4 are each composed of a plurality of tower pieces or boom pieces 3*a*, 3*b* . . . 3*n* or 4*a*, 4*b* . . . 4*n* respectively. The tower 3 and the boom 4 and their pieces can each be formed as lattice supports. The tower pieces 3*a*, 3*b* . . . 3*n*, for example, can each comprise four corner arms 5 which extend in the longitudinal tower direction and which can be connected to one another by cross-connectors in the form of transverse or diagonal bars so that the tower pieces and thus the tower 3 in its entirety have a quadrangular cross-section. In a similar manner, the boom or a respective boom piece can comprise three horizontal beams which are arranged in the longitudinal boom direction and which can be connected to one another by corresponding cross-connectors in the form of transverse and diagonal bars so that the boom in its entirety has a triangular cross-section. It is, however, understood that other cross-sectional shapes having different corner arm arrangements or horizontal beam arrangements can be provided.

Figure 2:
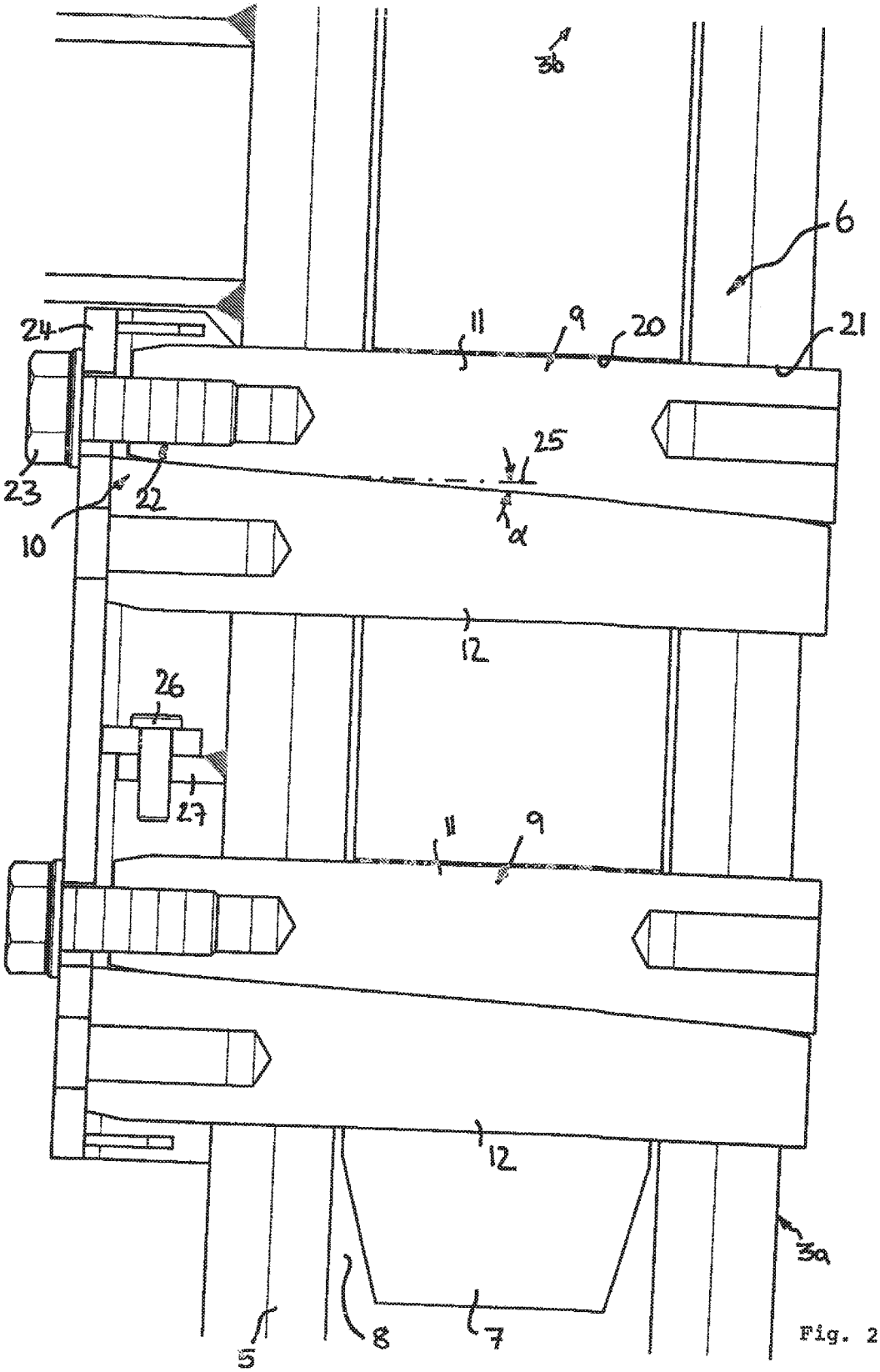
FIG. 2 shows a schematic sectional view of a mortise and tenon joint and its crossbar for connecting two tower pieces, wherein, in accordance with an advantageous embodiment of the invention, the two crossbars are each composed of two spreading wedges of half-shell shape.

As FIG. 2 shows, the tower pieces 3*a* and 3*b* can be connected to one another—in an analog manner also the boom pieces—by means of mortise and tenon joints 6 in the region of the corner arms 5, wherein the corner arm of a first tower piece 3*a* can comprise a tongue 7 which projects axially at the end face and which can move with an exact fit into a tongue receiver 8 at the end of the corner arm 5 of the other tower piece 3*b*. The named tongue receiver 8 can be a hole which is open at the end face, which extends in the longitudinal direction of the corner arm 5, which can be provided in the inner space of the corner arm 5 or in a connection piece welded thereto or fixed in another manner and which extends in the longitudinal direction of the corner arm 5. The tongue receiver 8 is adapted with respect to its cross-section and its dimensions to the tongue 7 so that the tongue 7 is seated with an exact fit at the tongue receiver 8.

Figure 8:
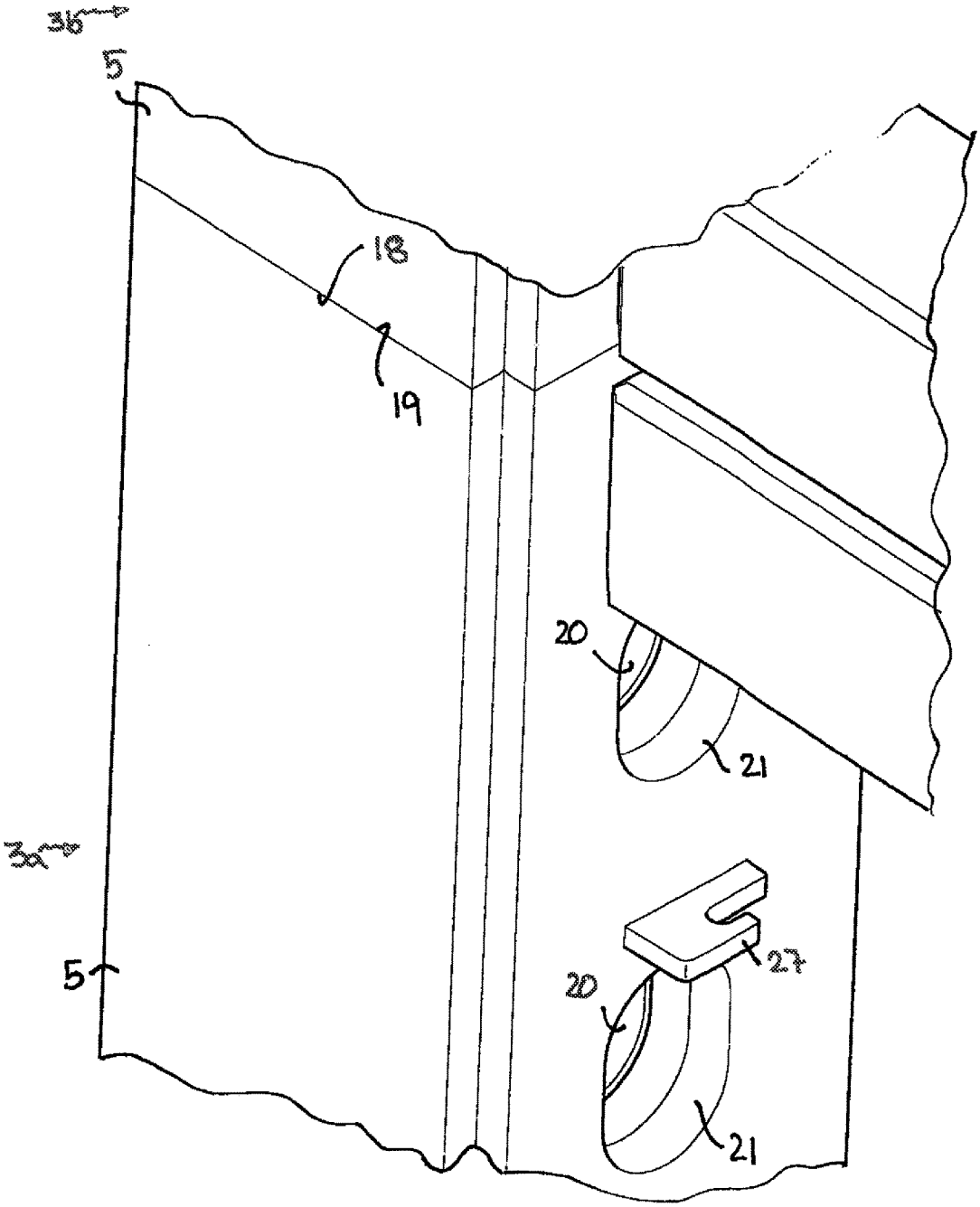
FIG. 8 shows a perspective representation of the corner arms of two tower pieces placed next to one another in the open, non-latched state, wherein the plug-through cut-outs in the cross-arm, which are of an elongate hole type in cross-section, and the holder for the holding abutment of the crossbars are shown.
Figure 9:
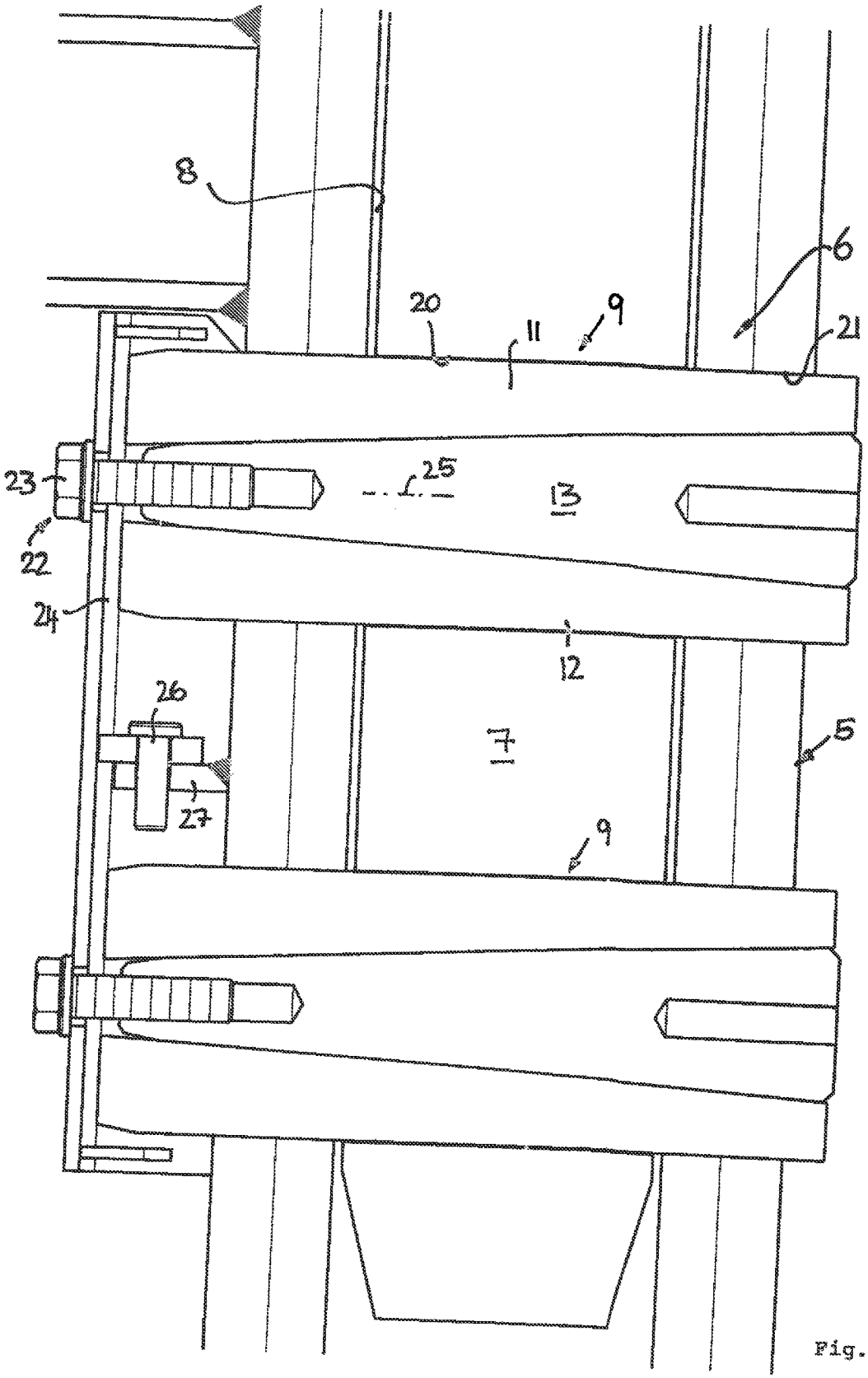
FIG. 9 shows a cross-section through the mortise and tenon joint between two tower pieces and their crossbars which are, in accordance with a further advantageous embodiment of the invention, composed of a respective three spreading wedges.
Figure 10:
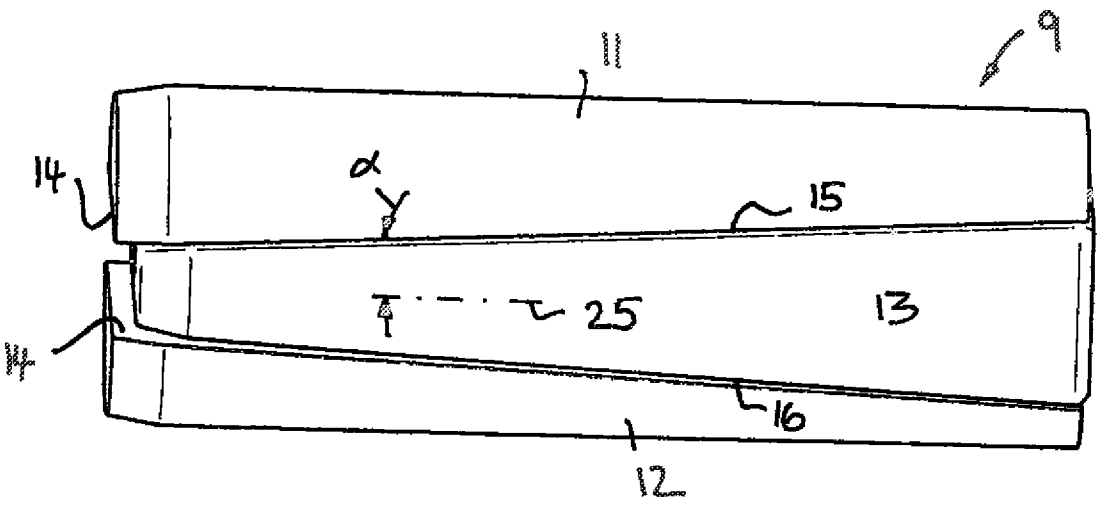
FIG. 10 shows a side view of a crossbar from FIG. 9, wherein the three spreading wedges are shown in the spread, widened state.
Figure 11:
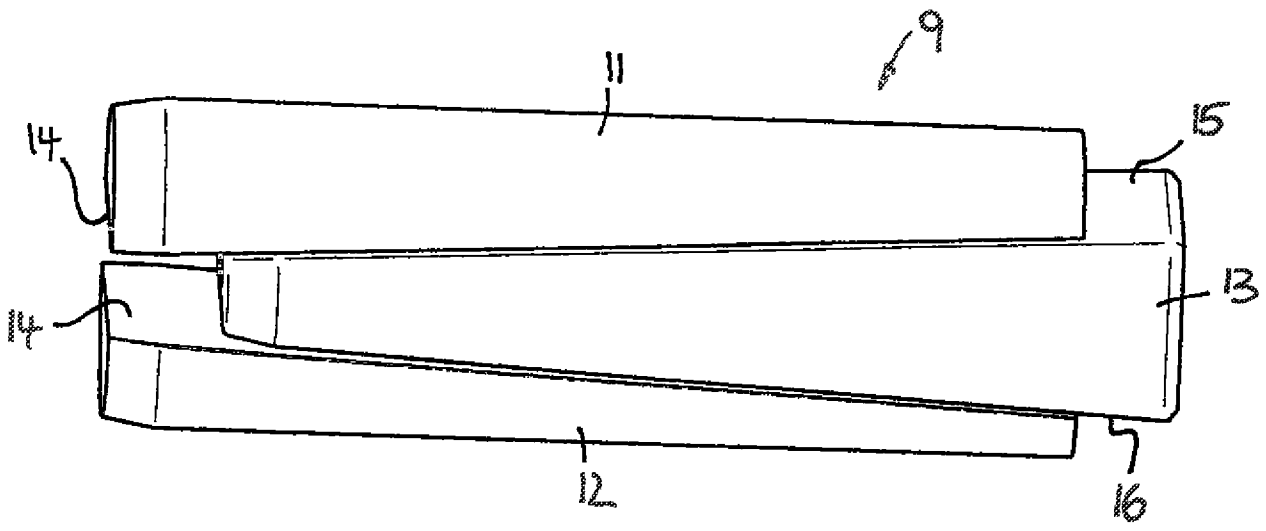
FIG. 11 shows a side view of the crossbar from FIG. 10 in the unspread, non-wedged state.
Figure 12:
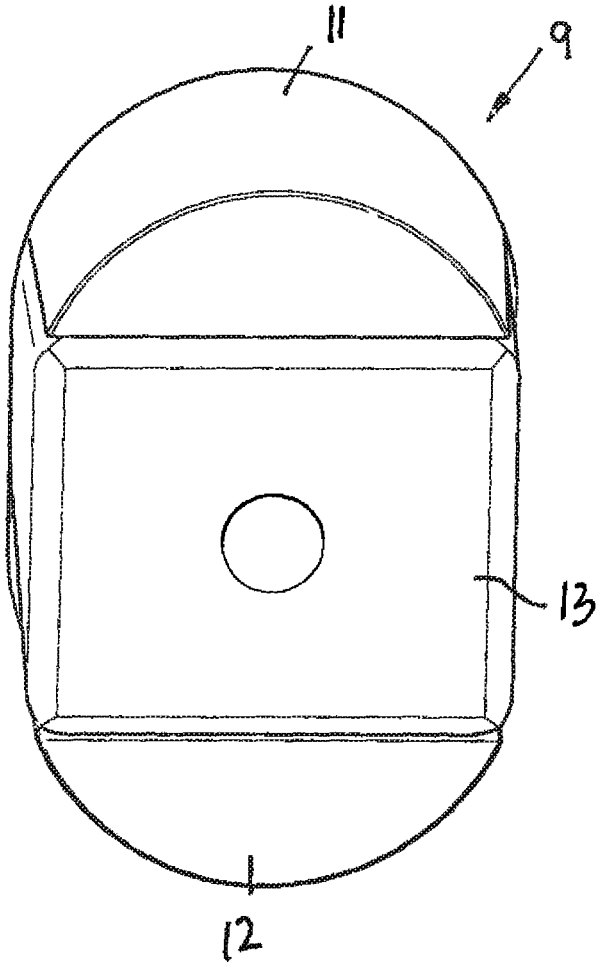
FIG. 12 shows an end-face representation of the crossbar from FIGS. 10 and 11 which show the cross-sectional contouring of the crossbar and its spreading wedges.

As FIG. 8 shows, the front faces at the end side of the corner arms 5 of the tower pieces 3*a* and 3*b* to be connected can abut one another when the mortise and tenon joint is moved in or the power pieces are positioned next to one another.

To secure the mortise and tenon joint 6 and to hold the tower pieces 3*a* and 3*b* at one another by a compressive force or to clamp the connection surfaces of the tower pieces 3*a* and 3*b* toward one another, the tongues 7 of the mortise and tenon joint 6 are secured and clamped in the tongue receiver 8 by means of crossbars 9. As FIG. 2 shows, two crossbars—optionally also more than two or also only one crossbar—can be provided per mortise and tenon joint 6 whose longitudinal crossbar axis 25 can extent transversely to the longitudinal tongue axis or transversely to the longitudinal corner arm axis or transversely to the longitudinal tower axis through the respective tongue 7 and also through the respective tongue receiver 8. The tongue 7 and the tongue receiver 8 have plug-in cut-outs 20 and 21 respectively for this purpose which can each be formed as passage cut-outs and which can be—approximately—aligned with one another or overlap one another so much when the tongue 7 has been moved into the tongue receiver 8 that the crossbar 9 can be plugged through the plug-in cut-outs 20 and 21.

As FIG. 8 shows, the named plug-in cut-outs 20 and 21 respectively can be contoured differently from the circular shape and can in particular be shaped as approximately oval or of elongate hole shape. The cross-sectional contouring of the named plug-in cut-outs 20 and 21 is in this respect adapted in shape to the cross-sectional contour of the crossbar 9 which can be spread apart and is also adapted with respect to the dimensions such that the crossbar 9 can be plugged in with an exact fit and can be spread apart.

Figure 3:
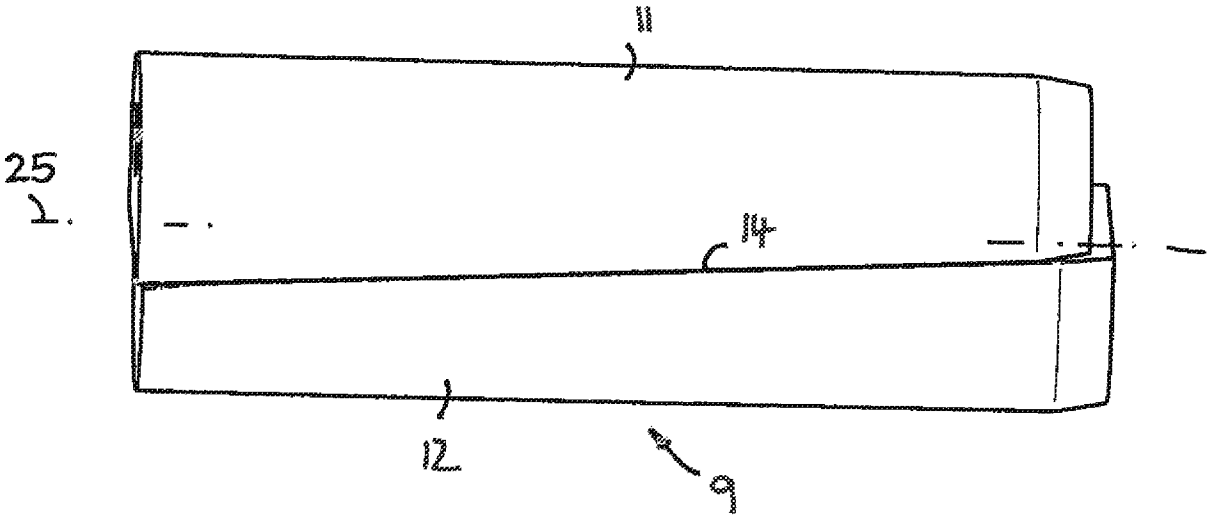
FIG. 3 shows a side view of a crossbar from FIG. 1 in the widened or spread apart or wedged state.
Figure 4:
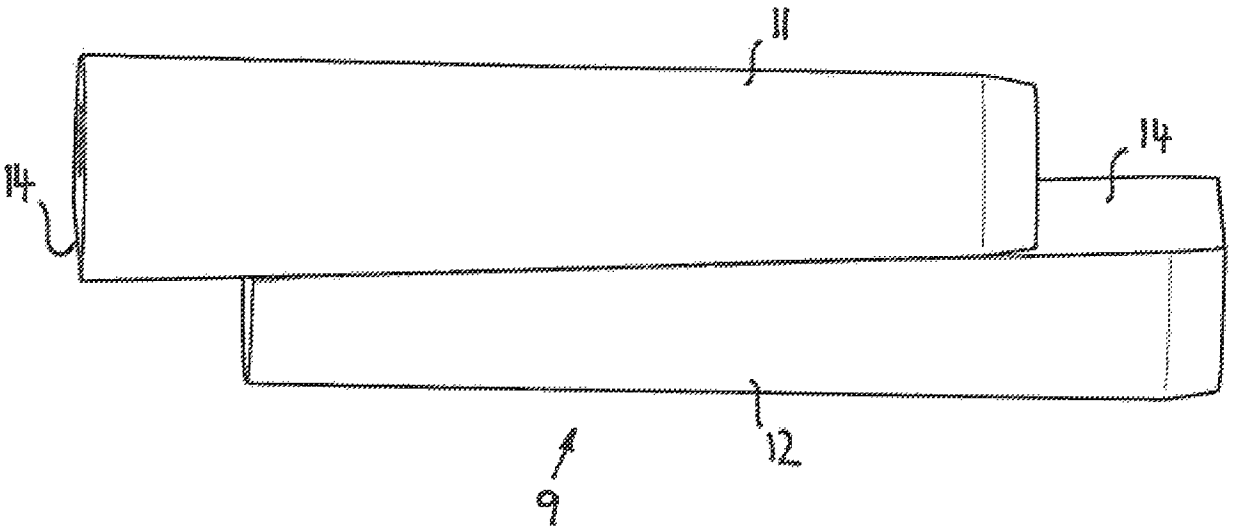
FIG. 4 shows a side view of the crossbar from FIG. 1 in the released or non-widened state.
Figure 5:
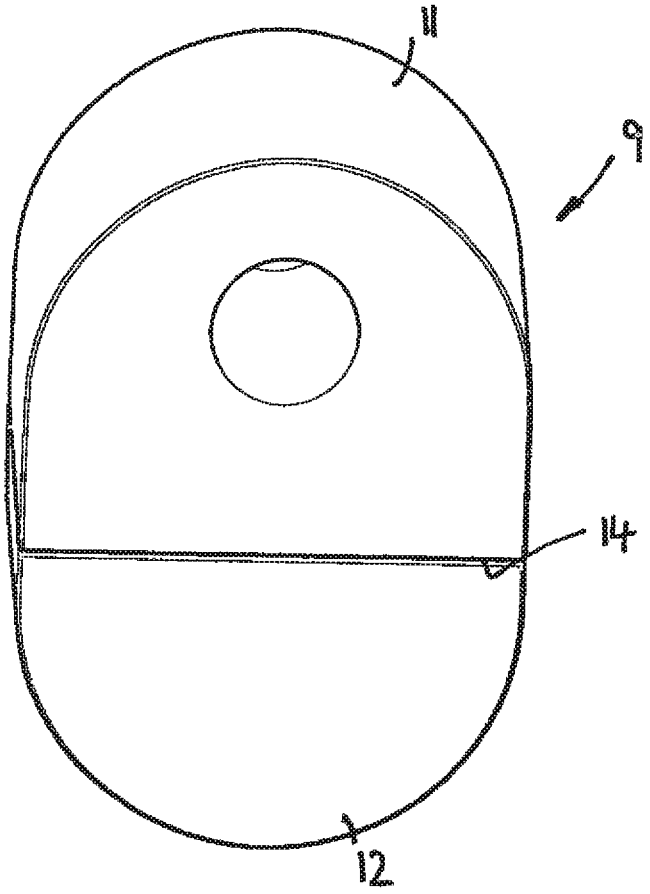
FIG. 5 shows an end-face view of the crossbar from FIG. 1 which shows the cross-sectional contouring of the spreading wedges of the crossbar of half-shell shape.

As FIGS. 3 to 5 show, the crossbar 9 can likewise have—viewed in its entirety—an approximately oval cross-sectional contouring, wherein the crossbar 9 can be composed of two spreading parts 11 and 12 which are both respectively contoured as elongate and which approximately form half tongues which supplement one another. The two spreading parts 11 and 12 are in particular each contoured in wedge shape and are formed as half-shells which each have a crescent-shaped or half-oval shaped cross-section. Viewed over the length, each of the spreading parts 10 and 11 tapers toward one side so that a wedge-shaped contouring is produced, wherein the oblique surfaces 14 of the two half-shells which are preferably planar lie on one another so that the crossbar 19 overall has the named oval cross-sectional contour. Viewed overall, the crossbar 9 forms a plug-in pin or a plug-in tongue which can be plugged transversely through the connection region of the corner arms.

As in particular FIGS. 2 and 3 show, the wedge-shaped half-shells, i.e. the spreading parts 10 and 11, are oriented in opposite directions from one another, i.e. the thinner end of the one spreading part 10 faces one end of the crossbar 9, whereas the other spreading part 11 faces the oppositely disposed end. The oblique surfaces 14 which lie on one another form a slanted longitudinal section or a slanted longitudinal section plane through the crossbar 9 which extends inclined at an acute angle toward the longitudinal crossbar axis 25.

As a comparison of FIGS. 3 and 4 makes clear, the crossbar 9 can be spread apart in that the two wedge-shaped spreading parts 10 and 11 are displaced relative to one another in the longitudinal direction of the crossbar so that they can slide off one another on their oblique surfaces. The crossbar 9 is hereby widened transversely to its longitudinal axis, i.e. the diameter dimension increases in a plane perpendicular to the oblique surfaces. The diameter measurement transversely to the named wedge action plane, however, remains the same.

The crossbars 9 are arranged in the corner arms or the elongate hole-like plug-in cut-outs 20 and 21 are oriented such that the spreading apart of the crossbar 9 takes place in the direction of the longitudinal axis of the corner arms 5, i.e. the two corner arms 5 to be connected to one another are drawn or pressed toward one another by spreading apart the crossbars 9 so that they are held on one another by compressive forces.

To be able to displace the spreading parts 10 and 11 relative to one another in the longitudinal crossbar direction and thus to be able to spread the crossbar 9 apart, the two spreading parts 10 and 11 are fixed to an abutment 24 at the end face, wherein an adjustment means 22, for example in the form of a screw 23, is associated with at least one of the spreading parts 11 and the spacing of the spreading part 11 from the abutment 24 can be varied by means of it. As FIG. 2 shows, one of the spreading parts 12 can in particular be fixedly fastened to the abutment 24 at the end face, whereas the other spreading part can be drawn onto the abutment 24 by a screw 23 or can be moved further away from the abutment 24 on a loosening of the screw 23 to reach the released or non-spread apart configuration shown in FIG. 4 or, conversely, to reach the spread apart configuration shown in FIG. 3.

The named abutment 24 can be secured at the corner arm 5 by holding means 26, for example in the form of a screw, or can be fastened to a securing hoop 27 attached thereto, cf. FIG. 8.

Figure 6:
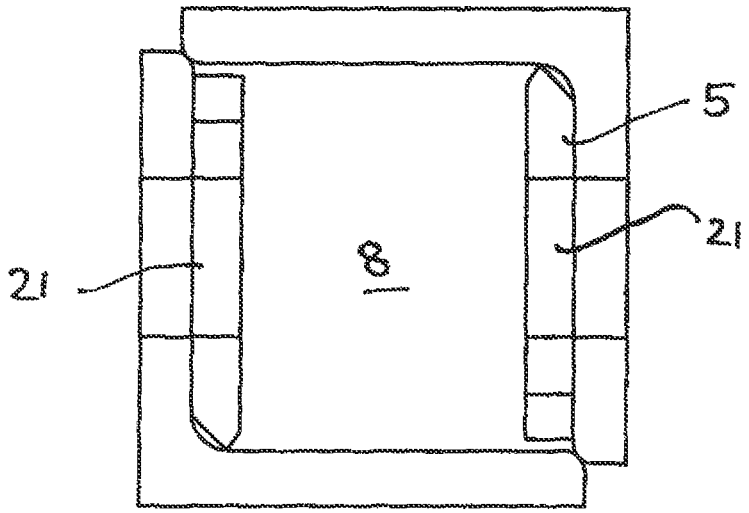
FIG. 6 shows a cross-section of the tongue receiver of a corner arm with the plug-through cut-outs provided therein for the crossbar of the mortise and tenon joint.
Figure 7:
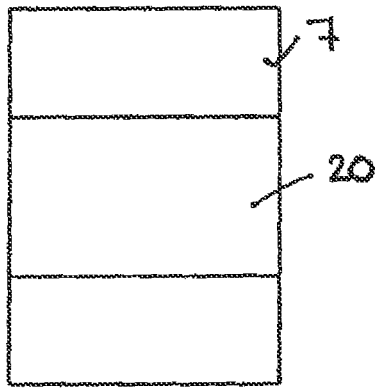
FIG. 7 shows a cross-section under tension of the tongue which can be inserted into the tongue receiver of the corner arm of FIG. 6.

The named abutment 24 can be configured in the form of a holding plate which surrounds the corner arm 5 at the peripheral side, cf. FIG. 6 or FIG. 2, for example in the form of an L-shaped metal holding plate, cf. FIGS. 2 and 6.

As FIGS. 9 to 12 show, the crossbar 9 can also be composed of more than two spreading parts and can in particular comprise a middle wedge 13 which can be arranged between two spreading wedges 11 and 12 which can have the same properties of the previously described half-shells of the previous embodiment. The two outwardly disposed spreading parts 11 and 12 in this respect bound a V-shaped intermediate space between them in which the named middle wedge 13 is received.

In a similar manner to the previously described embodiment, a screw 23 with which the middle wedge 13 can be adjusted with respect to the abutment 24 can be provided as an adjustment means 22 for spreading apart the crossbar 9. In another respect, this three-part configuration of the crossbar 9 corresponds to the previously described embodiment so that reference can be made thereto.

The connection of the longitudinal structural part pieces to be connected to one another works via a clamping effect due to the formation of sliding and spreading plane—or a plurality of such sliding and spreading planes. In this respect, tolerances can be taken up by the individual parts and a pre-loaded connection generating compressive force can nevertheless be achieved. A rotation of the individual parts in the installed state is prevented by the cross-sectional shape which differs from the circular shape and which is in particular approximately oval and it is additionally ensured that the crossbars 9 are installed in a correctly oriented manner. The individual parts of the crossbar 9 center themselves due to the shown shape of the individual parts.

To overcome the friction on the spreading apart of the crossbars 9, the crossbar 9 or its spreading parts 11, 12 and 13 can be provided with a friction-reducing surface coating. A greasing can optionally also be provided.

A pre-load in the corner arm of a connected tower piece or boom piece can be achieved by the spreadable crossbar 9. The operation is in this respect similar to a pre-loaded screw connection. The pre-load by the clamping effect as a consequence of the spreading apart of the crossbar 9 can be achieved by a simple adjustment screw 23 which is screwed at the end face into one of the spreading parts 11, 12 or 13, wherein a release of the connection during operation is made impossible by the applied pre-load.

The invention claimed is:

1. A crane having a multiple-piece longitudinal structural part that is either a tower or a boom, where pieces of the tower or boom comprise corner arms or horizontal beams which can be placed next to one another and which can be releasably connected to one another by a mortise and tenon joint, wherein the mortise and tenon joint comprises a tongue which can be plugged into a tongue receiver and which can be fixed in the tongue receiver by means of at least one crossbar insertable transversely to a plug-in direction of the tongue, wherein the crossbar can be spread apart by a spreading device such that the pieces of the longitudinal structural part to be connected can be clamped to one another by spreading apart the crossbar, wherein the crossbar comprises at least two spreading parts which are displaceable relative to one another in a longitudinal crossbar direction and which comprise at least one oblique surface which converts a relative movement of the spreading parts in the longitudinal crossbar direction into a spreading movement transversely to the longitudinal crossbar direction, and wherein the two spreading parts form crossbar half-shells which are seated on one another, the crossbar half-shells aligned in opposite directions to one another, where each of the crossbar half-shells has a cross-section that includes a rounded portion and a substantially planar portion, the cross-sections being an approximately crescent-shaped or semi-oval-shaped cross-section, wherein the crossbar has a cross-section differing from a circular shape, and wherein the crossbar has a cross-section that is approximately an oval cross-section.

2. The crane in accordance with claim 1, wherein the crossbar can be spread apart in a longitudinal direction of the tongue or of the longitudinal structural part in an inserted state such that the tongue can be clamped into the tongue receiver and the pieces of the longitudinal structure part can be clamped to one another in the longitudinal direction of the longitudinal structure part.

3. The crane in accordance with claim 1, wherein the oblique surface forms a slanted longitudinal sectional plane through the crossbar.

4. The crane in accordance with claim 1, wherein at least one of the spreading parts forms a spreading wedge, and wherein the crossbar half-shells are spread apart from one another via the spreading movement transversely to the longitudinal crossbar direction.

5. The crane in accordance with claim 1, wherein the two spreading parts forming the crossbar half-shells are of approximately the same size.

6. The crane in accordance with claim 1, wherein the crossbar comprises three or more spreading parts which are displaceable in the longitudinal crossbar direction relative to one another and have oblique surfaces aligned transversely with respect to a common spreading plane.

7. The crane in accordance with claim 1, further comprising a middle wedge having two oppositely disposed oblique surfaces arranged between two outer wedges which are both oriented in opposite directions to the middle wedge or which bound a V-shaped intermediate space between them in which the middle wedge is seated.

8. The crane in accordance with claim 1, wherein the at least one oblique surface is aligned substantially perpendicular to a plane which is defined by a longitudinal crossbar axis and by a longitudinal tongue or structural part axis.

9. The crane in accordance with claim 1, wherein the crossbar has a main cross-sectional axis which extends approximately in parallel with a longitudinal axis of the tongue or the longitudinal structural part.

10. The crane in accordance with claim 1, wherein the tongue or one of the corner arms or one of the horizontal beams having the tongue receiver has/have a plug-through cut-out for the crossbar which is adapted to the spreadable crossbar and which is of an elongated hole shape.

11. The crane in accordance with claim 1, wherein the horizontal beams or corner arms of two longitudinal structural part pieces to be connected to one another have end surfaces, wherein the end surfaces are end sides which can be clamped against one another with each of a first and a second plug-in cut-out in the tongue and the tongue receiver is spaced apart from the end surfaces such that a flush overlap can only be achieved under a preload by spreading apart the crossbar.

12. The crane in accordance claim 11, wherein the first plug-in cut-out in the tongue from the end surface of one of the corner arms or one of the horizontal beams having the tongue is smaller than a spacing of the second plug-in cut-out in the tongue receiver from the end side of the corner arm or horizontal beam having the tongue receiver.

13. The crane in accordance with claim 1, wherein the spreading device comprises adjustment means for adjusting at least a part of the crossbar in the longitudinal crossbar direction.

14. The crane in accordance claim 13, wherein the adjustment means comprise an adjustable tie rod, as well as an abutment which supports a first spreading part of the crossbar at an end side and supports the tie rod by which a second spreading part is adjustable at a spacing from the abutment.

15. The crane in accordance with claim 1, wherein the spreading parts of the crossbar have a wedge angle of a in a range from 0.5 degrees to 10 degrees, wherein the wedge angle can be one of between 1 degree to 5 degrees, and 2 degrees to 4 degrees.

16. The crane in accordance with claim 1, wherein the tongue and the tongue receiver comprise plug-in cut-outs, the plug-in cut-outs contoured to a shape and dimensions of the crossbar, and where the crossbar is plugged into the plug-in cut-outs with an exact fit.

17. The crane in accordance with claim 1, wherein the cross-section of each of the crossbar half-shells does not have a circular shape.

18. The crane in accordance with claim 1, where the substantially planar portions of the crossbar half-shells are positioned between the rounded portions of the crossbar half-shells.

19. The crane in accordance with claim 1, where the rounded portions of the crossbar half-shells are oriented away from one another and the substantially planar portions are positioned between the rounded portions.

* * * * *